US007387161B2

(12) United States Patent
Abass et al.

(10) Patent No.: US 7,387,161 B2
(45) Date of Patent: Jun. 17, 2008

(54) DETERMINATION OF WELL SHUT-IN TIME FOR CURING RESIN-COATED PROPPANT PARTICLES

(75) Inventors: Hazim H. Abass, Dhahran (SA); Mohammed H. Alqam, Qatif (SA); Mirajuddin Khan, Al-Khobar (SA); Abdulrahman A. Al-Mulhem, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 240 days.

(21) Appl. No.: 11/296,518

(22) Filed: Dec. 6, 2005

(65) Prior Publication Data

US 2007/0137859 A1 Jun. 21, 2007

(51) Int. Cl.
*E21B 43/267* (2006.01)

(52) U.S. Cl. ..... 166/280.1; 166/295; 166/308.5

(58) Field of Classification Search ..... 166/250.01, 166/280.1, 280.2, 295, 271, 177.5, 308.1, 166/308.5, 250.1; 507/924
See application file for complete search history.

(56) References Cited

U.S. PATENT DOCUMENTS

| | | | | |
|---|---|---|---|---|
| 3,049,410 | A | 8/1962 | Warfield et al. | |
| 3,929,191 | A * | 12/1975 | Graham et al. | 166/276 |
| 3,998,271 | A * | 12/1976 | Cooke et al. | 166/280.1 |
| 4,000,402 | A | 12/1976 | Higham | |
| 4,494,318 | A * | 1/1985 | Smillie | 34/112 |
| 4,581,253 | A * | 4/1986 | Evans et al. | 427/221 |
| 4,791,822 | A | 12/1988 | Penny | |
| 4,848,145 | A | 7/1989 | Blaschke et al. | |
| 4,922,758 | A | 5/1990 | Penny | |
| 5,018,396 | A | 5/1991 | Penny | |
| 5,500,174 | A | 3/1996 | Scott | |
| 5,501,275 | A | 3/1996 | Card et al. | |
| 5,520,250 | A | 5/1996 | Harry et al. | |
| 5,551,514 | A | 9/1996 | Nelson et al. | |
| 5,604,184 | A | 2/1997 | Ellis et al. | |
| 5,791,415 | A | 8/1998 | Nguyen et al. | |
| 5,924,488 | A | 7/1999 | Nguyen et al. | |
| 5,960,880 | A | 10/1999 | Nguyen et al. | |
| 6,059,034 | A | 5/2000 | Rickards et al. | |
| 6,079,492 | A | 6/2000 | Hoogteijling et al. | |
| 6,114,410 | A | 9/2000 | Betzold | |
| 6,155,348 | A | 12/2000 | Todd | |
| 6,172,011 | B1 | 1/2001 | Card et al. | |
| 6,209,643 | B1 | 4/2001 | Nguyen et al. | |
| 6,257,335 | B1 | 7/2001 | Nguyen et al. | |
| 6,279,656 | B1 | 8/2001 | Sinclair et al. | |
| 6,311,773 | B1 | 11/2001 | Todd et al. | |
| 6,528,157 | B1 | 3/2003 | Hussain et al. | |
| 6,668,926 | B2 | 12/2003 | Nguyen et al. | |

* cited by examiner

*Primary Examiner*—Kenneth Thompson
(74) *Attorney, Agent, or Firm*—Abelman, Frayne & Schwab

(57) ABSTRACT

A laboratory test method employs maximum acoustic wave velocity to determine cure time of a sample of curable resin-coated proppant (CRCP) that are packed in a pressurized chamber to simulate conditions in a reservoir rock formation during fracturing in which the CRCP will be used. The pressurized CRCP is subjected to a varying temperature profile that replicates the reservoir temperature recovery during shut-in of the fractured zone in order to develop maximum proppant pack strength and minimize proppant flow back following completion of the fracturing operation and to determine shut-in time to complete curing of the resin.

18 Claims, 5 Drawing Sheets

DETERMINATION OF WELL SHUT-IN TIME FOR CURING RESIN-COATED PROPPANT PARTICLES

FIELD OF THE INVENTION

The invention relates to the determination of the cure time under actual field conditions for curable resin-coated proppant, or "CRCP", used in a reservoir fracturing treatment employed to increase hydrocarbon production from a well.

BACKGROUND OF THE INVENTION

Proppants and proppant additives are increasingly used in screenless completions. In these applications, no screen or annular gravel pack is used to support the proppant in the perforation and the fracture. The proppant pack should not flow back in the bore hole if the stimulation treatment is successful. For screenless completions to be successful for the long term, the proppant pack and perforation tunnel must retain stability and conductivity under production conditions of temperature, fluid flow, stress cycling, and drawdown pressure during the life of the well. Therefore, screenless completions necessitate that the CRCP attain the maximum possible strength in the fracture and in the perforation tunnels. The strength is necessary to prevent proppant flowback anticipated at high production rates following fracturing. The practice in the prior art has been to evaluate proppants by measuring either consolidation strengths or fracture conductivity, the tests being conducted under simulated downhole conditions with an API cell.

Proppant hydraulic fracturing is a part of a treatment performed to stimulate oil/gas wells to enhance production, and in sandstone reservoirs it serves the purpose of mitigating production of sand due to the increased draw-down pressure. A CRCP is usually used at a final stage to prevent proppant flow-back upon putting the well on production.

The use of CRCP is intended to solve the problem of proppant flowback by having the curing resin form a pack that maintains its structural integrity when hydrocarbon production is commenced. It was known that the well should be closed and the fracture closed on the proppant to allow the resin to bind the proppant grains together in order to form a strong proppant bed or pack before a given well was put on production. The production engineers want to put the well on production as soon as possible, since the costs in time, labor, materials and equipment are substantial. However, it has been found that CRCP will flow back into the well when the well is put back on production.

No basis exists in the art for determining the required shut-in time, other than the time needed for a fracturing gel to break. Similarly, no consideration was given to the strength development of CRCP. Gel breakers are used in fracturing fluids to trigger gel degradation of polymeric materials predetermined period of the completion of a stimulation treatment. The shut-in time designed for fracturing treatments is based on the shut-in time required to achieve polymer degradation. There is no indication in the literature on how long it takes the CRCP to achieve its maximum strength and what property might be relied upon to determine its strength development. The failure to achieve a complete cure for the CRCP is counter-productive.

When a reservoir rock formation is fractured and proppants are pumped into the formation to maintain the opened flow paths following relief of the pressure of the fracturing fluid, the temperature of the reservoir in the fractured zone is altered, i.e., lowered, by introduction of the various fluids.

Thus, it is known that the reservoir temperature decreases due to the cooling effect caused by injecting a large volume of fracturing gel that is at ambient surface temperature into the formation. However, this effect has not been considered when determining the in situ curing time of a given CRCP.

During the shut-in time, i.e., the time that the well is out of production, the temperature of the fluids and CRCP in the fractured zone increases as the introduced materials absorb heat conducted from the surrounding formation. This downhole temperature recovery over time can be measured and expressed graphically, i.e., by a plot or curve, or in a tabular form and stored in electronically.

The temperature recovery curve is characteristic for a given type of reservoir formation and is reasonably predictable or consistent for a given oil field or geological region, and depth. As will be understood by those familiar with the art, downhole temperature also varies with depth, the temperature generally being higher at greater depths.

A variety of resin products and CRCP are available from commercial sources. Test data is provided by the manufacturer that indicates the time required for complete curing and compressive strength development of the resin at a given constant temperature. In general, there is not a linear relationship between cure time and temperature, so that determination of the cure time for a batch of CRCP under conditions of changing temperature cannot be readily determined theoretically from uniform temperature and time data.

Currently, the duration of the shut-in time following a hydraulic fracturing treatment that uses CRCP to prevent proppant flow-back into the well with produced hydrocarbons does not account for the effect of shut-in time required for complete compressive strength development. As a result, proppant particles that have not completely cured to form a monolithic pack are displaced by the subsequently produced hydrocarbon and the value and expense of the treatment has been lost, at least in part.

The testing methods currently practiced in the industry to qualify proppant for field applications are based on the physical characterization of a number of parameters, such as specific gravity, absolute volume, solubility in HCl/HF acid, roundness, sphericity and bulk density. A sieve analysis, compressive strength and API crush tests are also performed. The API series RP 56, 58 and 60 are the principal procedures used to test conventional proppants for hydraulic fracturing treatments. At present however, there is no API testing procedure for CRCP proppants It is therefore an object of the present invention to provide a new test method and associated apparatus set up for determining the minimum shut-in time after a CRCP has been introduced into the formation to effect complete curing of the resin and maximum pack strength under conditions that simulate actual reservoir conditions during and after fracturing treatment.

Another object of the present invention to provide a direct, reliable and easy to apply laboratory test method for qualifying a given CRCP for use in a reservoir under known stress and temperature conditions.

A further object of the invention is to provide a laboratory test method that is simple to apply and that produces reliable results for predicting time to achieve optimum compressive strength of a CRCP proppant pack under pressure and when the CRCP is subjected to a varying curing temperature that is representative of conditions in a subterranean treatment in which the proppant will be used.

Yet another object of this invention is to provide a laboratory test method for evaluating a number of different commercial CRCP products to develop a database of cure times under the same and different conditions to aid in the future selection of a CRCP product that will minimize the shut-in time, and thereby the costs associated with a fracturing treatment of a particular reservoir, under expected field conditions of pressure, temperature and temperature recovery.

A further object of this invention is to provide a laboratory test method that will prevent or minimize CRCP proppant degradation and the undesirable attendant flowback when a well is returned to production.

It is also an object of the invention to provide manufacturers and users of CRCP proppants with a laboratory test method for determining the effect of curing temperature variations on compressive strength development.

SUMMARY OF THE INVENTION

The above objects and other advantages are provided by the apparatus and method of the invention which comprehends a laboratory test for determining the minimum and/or optimum curing time for a curable resin-coated proppant (CRCP) sample under conditions simulating those encountered in the field during the hydraulic or acid fracturing of subterranean reservoir formations to improve the flow of hydrocarbons, the method comprising:

a. placing a quantity of the CRCP sample in a pressure vessel at ambient conditions;
b. placing velocity transducers in contact with opposing sides of the CRCP sample contained in the pressure vessel;
c. sealing the pressure vessel and applying an external hydrostatic force of predetermined value to the CRCP sample;
d. increasing the temperature of the CRCP sample in the vessel at a predetermined rate, to thereby effect the gradual curing of the resin;
e. activating the velocity transducers at predetermined time intervals to transmit waves of a predetermined fixed frequency as the temperature of the CRCP sample increases;
f. measuring the acoustic velocity of the waves passing through the CRCP sample when the transducers are activated;
g. recording the temperature in the pressure vessel at which the maximum wave velocity is attained, said temperature corresponding to the temperature at which the resin coating on the proppant is cured; and
h. correlating and recording the value of the temperature as determined in step (g) with the time required to reach said temperature from a temperature recovery shut-in data source, to thereby determine the shut-in time that is required for the temperature to reach the temperature for curing the resin.

It has been found that the completion of the curing of the resin on the CRCP corresponds to the attainment of the maximum velocity for the waves passed through the sample by the velocity transducer apparatus. The method of the invention uses this characteristic to determine the cure time in the test cell under the conditions of temperature and pressure that can be expected to prevail in the field during the fracturing treatment. As defined by the present invention, the pressure is maintained at a substantially constant value and the temperature is varied, i.e., increased, in accordance with the temperature recovery curve or function of the reservoir rock.

Another supporting test can be performed to determine the additional time required to obtain maximum strength. The test procedure includes curing several samples at in-situ stress pressure at the temperature obtained from the first test, but for different times, in order to determine the time required to obtain maximum cured strength. The proppant in the perforation tunnels should be cured at a much lower stress to reflect the actual confining stress to which the proppant is exposed at that location. Each of the samples are then tested for compressive strength.

A compressive strength-time function is plotted to determine the additional time for maximum strength development. This time is added to the time determine in step (h) above to get the shut-in time required following a given fracturing treatment that uses the CRCP sample tested. It is usually greater than the time it takes to break the fracturing gel.

This method serves at least two very practical purposes having use during field operations: (a) determining the appropriate shut-in time; and (b) providing a controlling variable for quality control and quality assurance of a given CRCP commercial product. The physical properties measured are acoustic velocity and compressive strength.

The novel method of the invention permits the determination of the degree of strength development for a given sample of CRCP during the curing process under in-situ stress and increasing temperature conditions. This aspect of the test method takes into consideration the cooling effect of the fracturing fluids and determines the temperature at which a given CRCP sample attains maximum acoustic velocity. It has been found that the maximum acoustic velocity directly correlates to the maximum resin strength developed during the curing process.

The dynamic Young's modulus is determined from the acoustic velocities. The method of the invention provides the solution to the long-standing problem of finding a strength indictor under conditions where the temperature increases.

A series of laboratory have tests established that the CRCP compressive strength is a function of curing time under a given stress, i.e., pressure, and curing temperature. A functional relationship between compressive strength and curing time was introduced and it was found that the compressive strength approaches an asymptotic value after some time for a given proppant type, curing fluid, stress and temperature. The time at which the compressive strength reaches the asymptotic value is added to the time it takes the reservoir to reach the curing temperature to obtain the shut-in time required to achieve a maximum compressive strength of a given CRCP.

In one preferred embodiment, the sample is subjected to a varying temperature profile that corresponds to a previously measured temperature recovery profile of one or more reservoirs that have been fractured and that are typical of the reservoir in which the CRCP of the test sample is to be used. In a preferred embodiment the fracturing fluid is also included as one of the variable that is simulated in the laboratory to provide an experimental environment that allows for determining the effect of time-dependent increasing temperature on strength development of a given CRCP sample.

The apparatus and method of the invention also comprehends its use in a quality control or quality assurance program and provides the means for characterizing a plurality of proppant materials of the same or different types from one or more commercial suppliers to determine their suitability under various conditions of use in the field. As previously noted, suppliers of CRCP provide data on expected/estimated cure times at specified temperatures. The method of the invention is used to test each proppant material at one or more pressures corresponding to the anticipated fracturing pressures and also subjecting the CRCP to the time-temperature recovery profiles derived from historical data from one or more fields or geological locations that are typical of well sites in which future fracturing treatments will be applied. The times required to reach maximum cure strength for each of the CRCP samples at varying pressures and under the varying temperature recovery profiles is maintained in a database. It will be understood that as used in this description of the invention, the term database can include digitally stored data, electronic or printed tables and graphic data representations. Preferably, the database is in electronic form and can be accessed and downloaded for use in a software or other form of program that is used to control the temperature of the sample tested.

When used for quality control and/or quality assurance, samples of the same product received from the same supplier at different times are tested for consistency and reproducability of results. In a particularly preferred manner of employing the methodology of the invention, the proppant material suppliers are required to test samples of their product before shipment in order to confirm and certify that the batch in question meets the user's specifications for a specific intended fracturing treatment.

The database of cure times stored in accordance with this aspect of the invention can also be used to select the optimum CRCP for use in a given section of reservoir rock under the conditions of pressure and temperature that are expected to prevail based upon historical experience. In this application of the invention, the selection of the CRCP is optimized by choosing a material that will assure a proppant pack of maximum compressive strength in the least amount of shut-in time. As previously noted, the cost of the overall fracturing treatment increases with the length of time that the well is shut-in, i.e., maintained under pressure and out of production. Thus, the sooner the well can be brought into production following the initial fracturing and injection of CRCP materials, the less will be the expense incurred, assuming, of course, that the proppant pack holds and functions as intended. Under optimum conditions the time required to obtain maximum strength of CRCP is close or equal to the time needed to break the gel.

Thus, in this embodiment the invention comprehends a method for optimizing the shut-in time during the hydraulic fracturing of a subterranean reservoir rock formation and the injection of a quantity of a specified type of curable resin-coated proppant (CRCP) to maintain the fractures and/or prevent proppant flow-back into the well bore, where the shut-in time is the period during which pressure is maintained to effect curing of the resin coating to form a proppant pack of maximum strength, the method comprising:

a. determining the temperature and pressure values of the reservoir during the fracturing process based on historical data;
b. preparing a mathematic representation of the temperature recovery of the fractured formation in the form of a temperature recovery shut-in data source;
c. preparing a test sample of CRCP sample of the type to be used in the fracturing process;
d. placing a quantity of the CRCP sample in a pressurized vessel at ambient conditions;
e. placing velocity transducers in contact with opposing sides of the CRCP sample contained in the pressure vessel;
f. sealing the pressure vessel and applying an external hydrostatic force of predetermined value to the CRCP sample;
g. increasing the temperature of the CRCP sample in the vessel at a predetermined rate to thereby effect the gradual curing of the resin;
h. activating the velocity transducers at predetermined time intervals to transmit waves of a predetermined fixed frequency as the temperature of the CRCP sample increases;
i. measuring the acoustic velocity of the waves passing through the CRCP sample when the transducers are activated;
j. recording the temperature of the CRCP sample at which the maximum wave velocity is attained, said temperature corresponding to the temperature at which the resin coating on the proppant is cured;
k. correlating and recording the value of the temperature as determined in step (j) with the time required to reach said temperature from a temperature recovery shut-in data source;
l. injecting an effective quantity of the type of CRCP prepared in step (c) into the fractured formation;
m. maintaining the pressure for a shut-in time that corresponds to that determined in step (k) to establish a cured CRCP pack of optimum strength; and
n. returning the formation to production.

The apparatus of the invention includes a test cell fitted with acoustic transducers for receiving the sample, a source of pressurizing heat transfer fluid, a variable heater and a programmed temperature controller containing one or more programs with historic time-temperature recovery data or profiles for reservoir fracturing treatments.

The invention broadly comprehends identifying a physical characteristic, attribute and/or parameter for the CRCP that serves as an indicator of the fully-cured state of the resin coating and measuring this characteristic in the laboratory under conditions of pressure and temperature that simulate those of a reservoir that is to be fractured and into which the proppant is to be injected.

BRIEF DESCRIPTION OF THE DRAWINGS

The invention will be further described below and with reference to the attached drawings, wherein the same or similar elements are referred to by the same numbers, and where.

DETAILED DESCRIPTION OF PREFERRED EMBODIMENTS OF THE INVENTION

Figure 1:
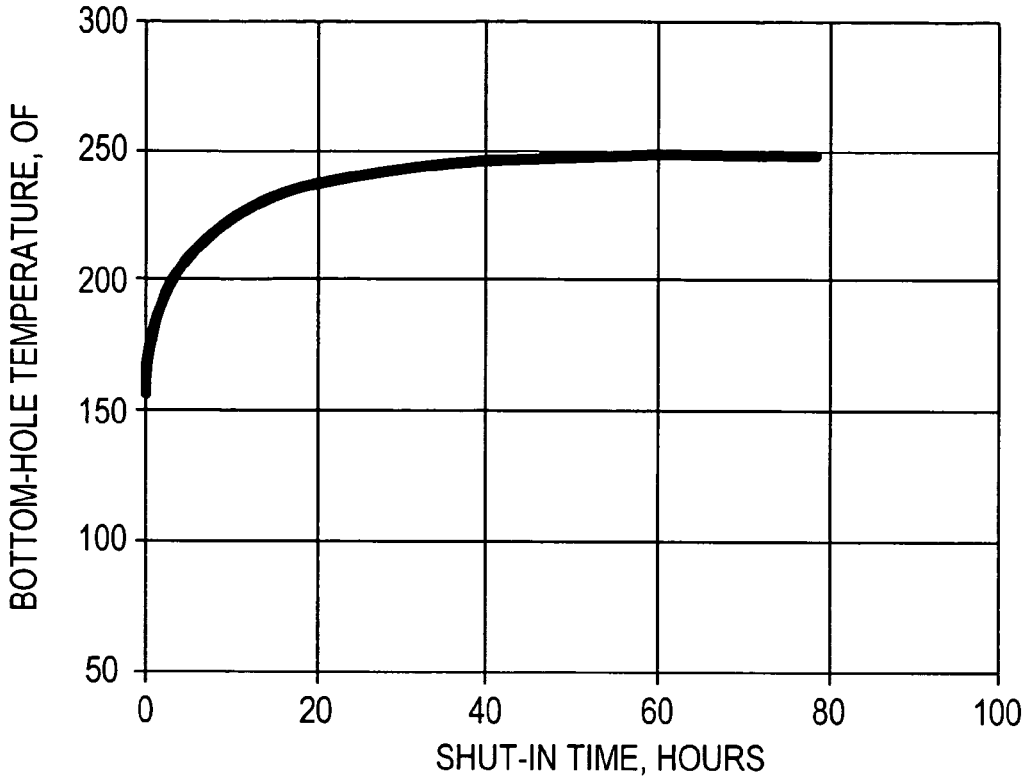
FIG. 1 is a graphic plot of the shut-in time versus bottom-hole temperature following introduction of the fracturing fluid and subsequent treatment.

Referring to FIG. 1, a graphic plot of the shut-in time vs. bottom-hole temperature illustrates the temperature recovery during shut-in of a well that has been subjected to introduction of one or more fracturing fluids and other treating fluids. In this instance, the temperature was reduced by about 100° F. upon introduction of pressurized liquids from the surface at ambient temperature. Approximately sixty hours was required for the bottom hole formation temperature to again reach 250° F. This temperature recovery plot is representative for a given type of reservoir rock formation at this temperature. Wells to be fractured in the vicinity of this well and in formations having similar geology, will produce similar plots of the temperature recovery profile.

As can be seen from the plot of FIG. 1, the temperature recovery curve is not linear with time, but initially rises steeply and then flattens out to approach the surrounding formation temperature almost asymptotically. In accordance with the method and apparatus of the invention, samples of commercial CRCP proppant material are subjected to testing in accordance with a temperature recovery profile, such as that of FIG. 1, that has been obtained empirically from a well or wells in a formation of the type that is to be fractured and propped. It is to be understood that strength development is not only a function of a specific temperature at a given time, but also the history of temperature increase from an initial state to the specific temperature. Therefore, the actual plot of temperature increase must be simulated in the lab.

Conventional mechanics laboratory equipment is employed to determine sonic wave velocities through test samples in order to determine dynamic elastic properties of the sample. Test equipment directs a compressional wave (P) and orthogonal shear waves (S1 and S2) through the samples. In accordance with the invention, it has been found that the measurement of the compression wave (P) passed through a sample of CRCP can be utilized to identify the maximum or completed cure of the resin coating on the particles. When the resin has reached its completed cure state, the wave velocity also reaches a maximum value. This finding is utilized in the practice of the method and apparatus of the invention to determine the minimum shut-in time required after fracturing of a well and injection of CRCP to achieve a complete cure.

Thus the use of acoustic velocity measurements while the CRCP sample is being heated to replicate conditions of downhole temperature recovery is one aspect of the present invention. The finding that acoustic velocity through the packed CRCP in the test cell is a function of the state of cure, and that maximum wave velocity is achieved when the cure is completed is deemed to be a significant contribution to the art.

The empirically obtained recovery time temperature profile is preferably stored in digital form and utilized with a programmable liquid heating system, having a controller that functions in connection with a general purpose computer. Such systems are commercially available for use in laboratories and their use is described in further detail below.

Figure 3:
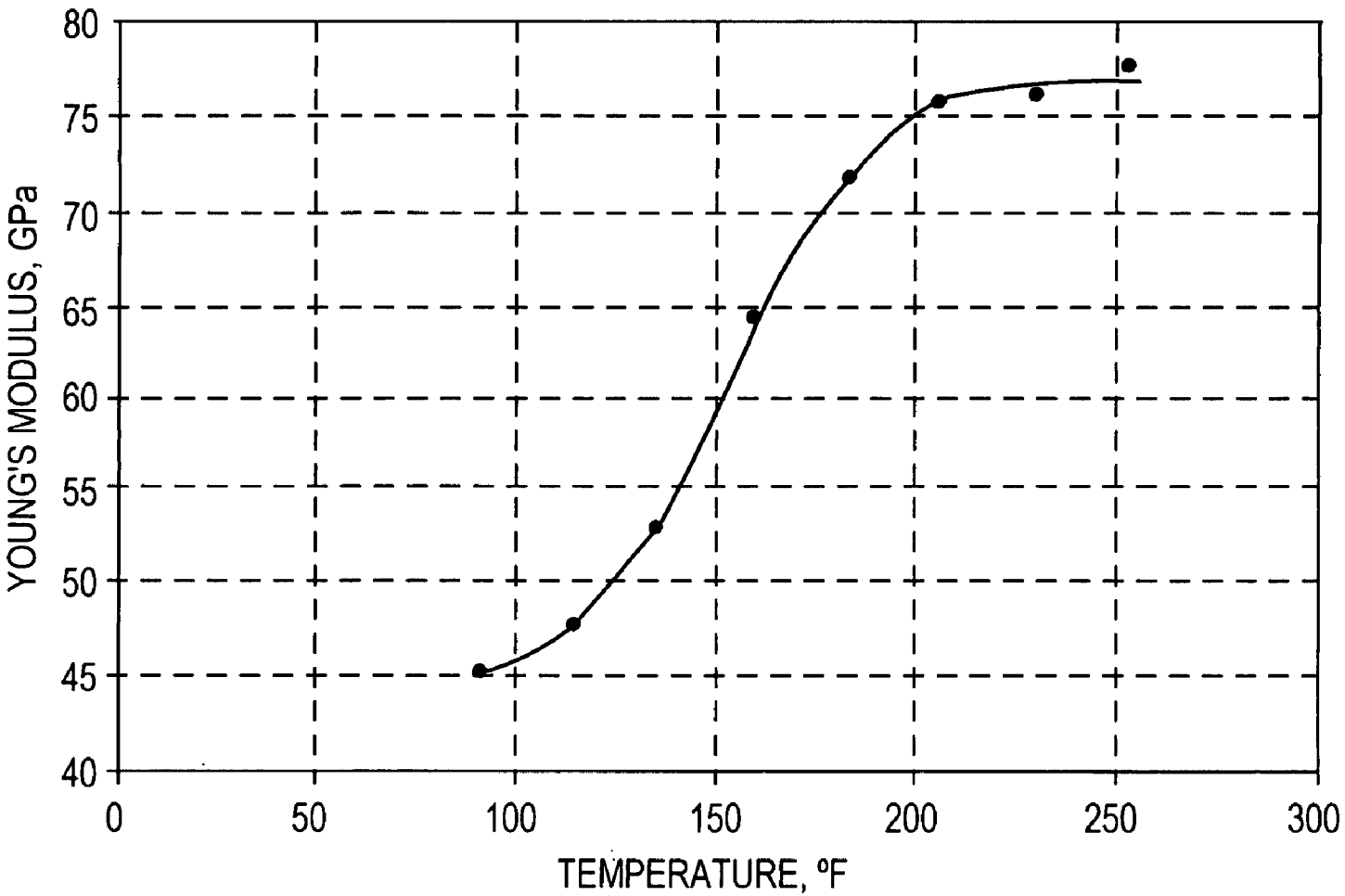
FIG. 3 is a graphic plot of the development of Young's Modulus versus temperature for a sample during curing.

Referring now to FIG. 3, the wave velocity is shown plotted for the three coordinates of P, S1 and S2 as temperature increases for a given sample of CRCP. The proppant particles used in this example are saturated in 10% by weight potassium chloride (KCl). The 10% weight KCl is prepared by dissolving 10 gms. KCl in 90 gms. distilled water.

Based upon data from a large number of tests, it has been determined that the measurement of the acoustic velocity for compression (P) is a reliable indicator of cure strength; the orthogonal shear wave velocity measurements (S1, S2) can, therefore, optionally be omitted.

Figure 4:
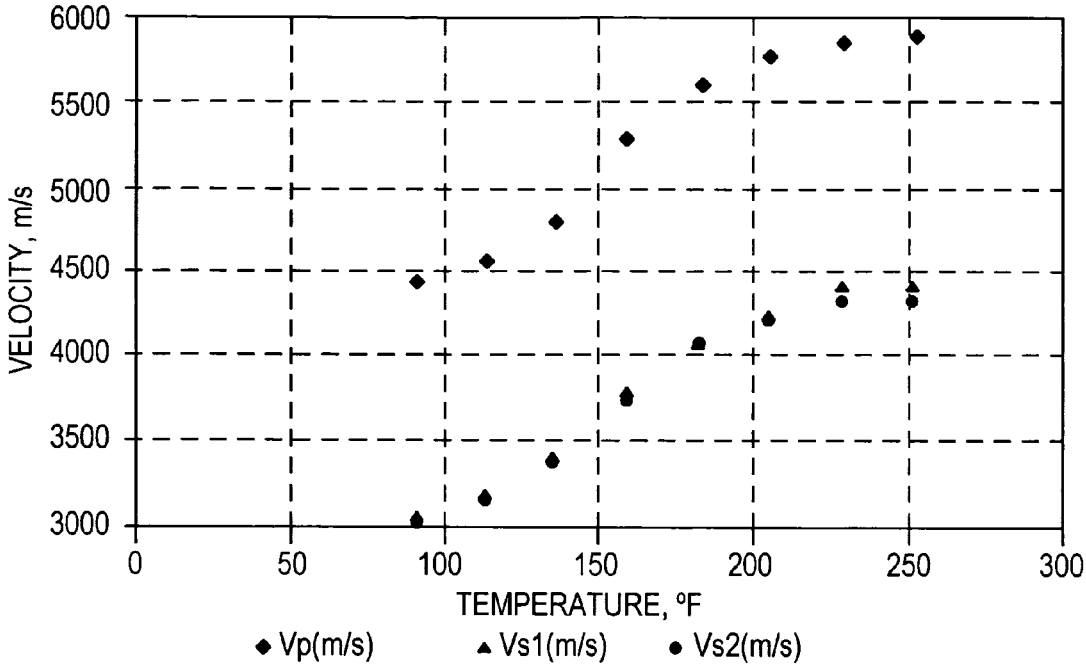
FIG. 4 is a graphic plot of acoustic velocities vs. temperature for two different resin coated proppants.
Figure 5:
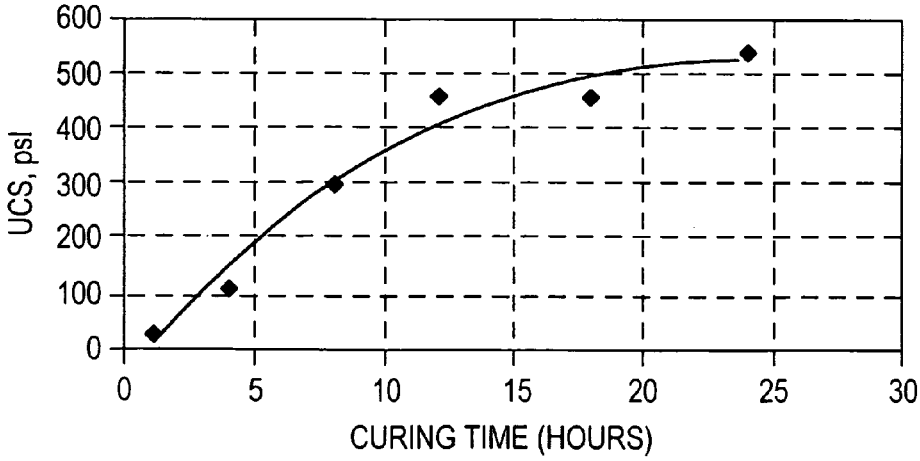
FIG. 5 is a graphic plot of the compressive strength vs. time for a CRCP sample cured at optimum curing temperatures at a fixed pressure.

This graph of FIG. 4 illustrates how acoustic velocity increases as the sample cures at the higher temperature, reaching a maximum velocity at about 230° F. to 250° F. The plot of FIG. 5 shows the relationship of compressive strength development, UCS (psi) vs. curing time for RCP cured for sixteen hours at 280° F. (10% KCl). This particular material reached a maximum compressive strength in just under twenty-five hours. This plot of the compressive strength versus time indicates that the optimum time for a maximum strength can be identified, since a point is reached at which additional time does not produce an appreciable increase in compressive strength.

Figure 6:
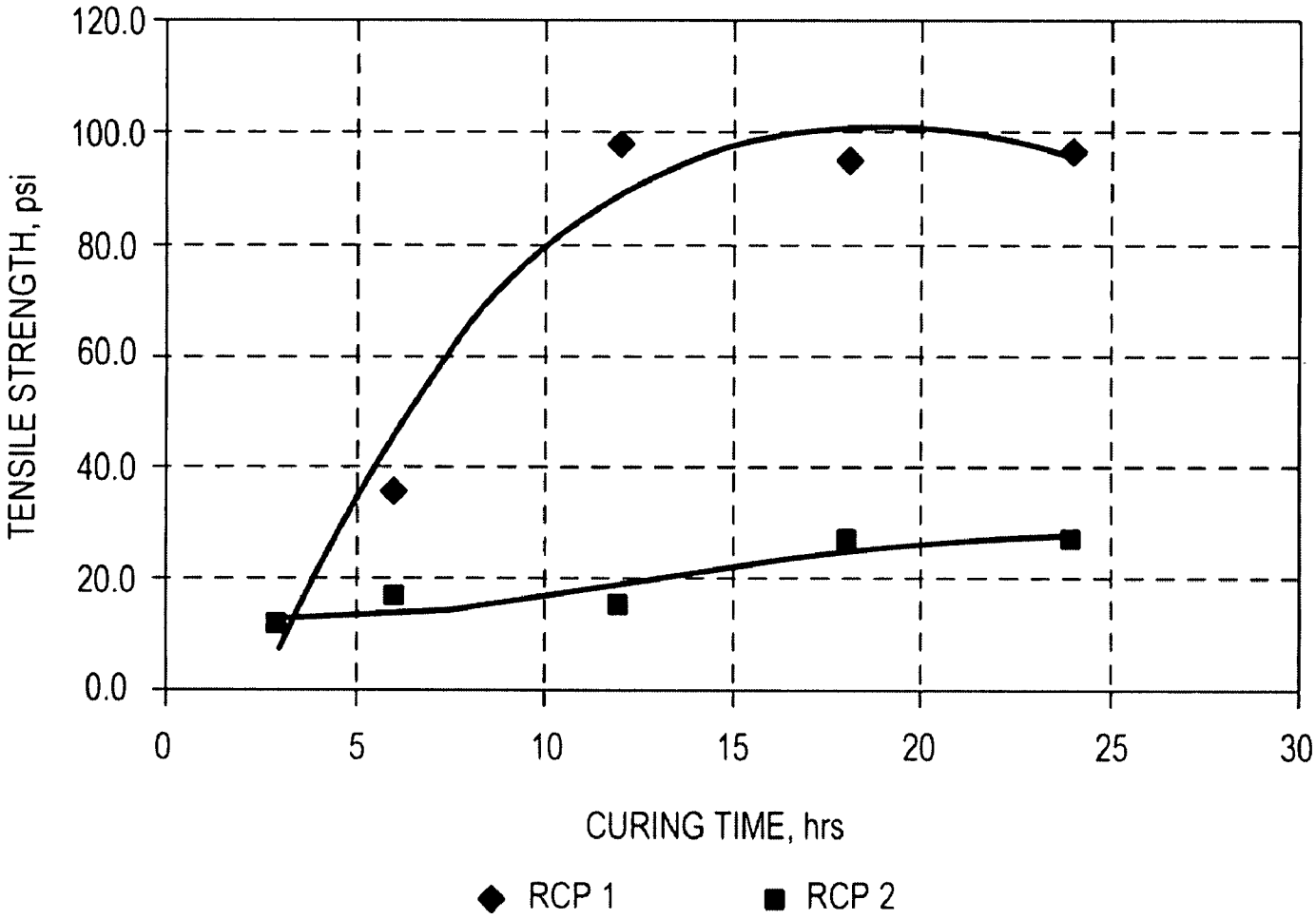
FIG. 6 is a graphic plot of the tensile strength vs. curing time using the method of the invention.

The tensile strength developed during curing of two different CRCP samples subjected to testing in accordance with the invention are plotted against time in FIG. 6. This plot illustrates the significant differences between the characteristics of different products.

Figure 2:
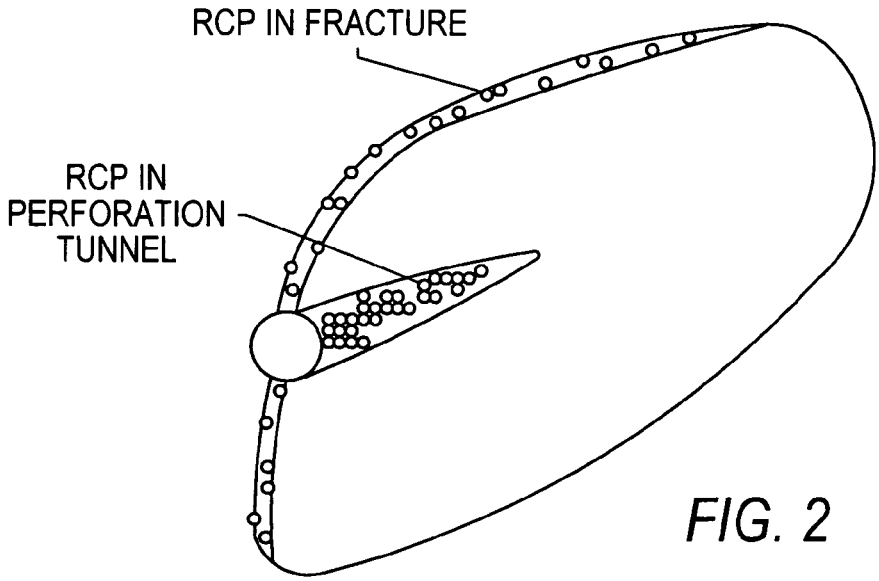
FIG. 2 is a sectional schematic view of a portion of reservoir rock illustrating the presence of proppant following fracturing.

The sectional view of FIG. 2 schematically illustrates a slice of reservoir rock following introduction of proppants. The particles can serve the purpose of maintaining flow paths through the fractured formation and also of blocking the flow of sand with produced hydrocarbons. The proppant in the perforation tunnels is subjected to a different and less stress than the particles in the newly-opened fractures. Thus, even though the CRCP is subjected to the same curing temperature profile, the in situ curing stresses or pressures that can effect curing time are different.

Figure 7:
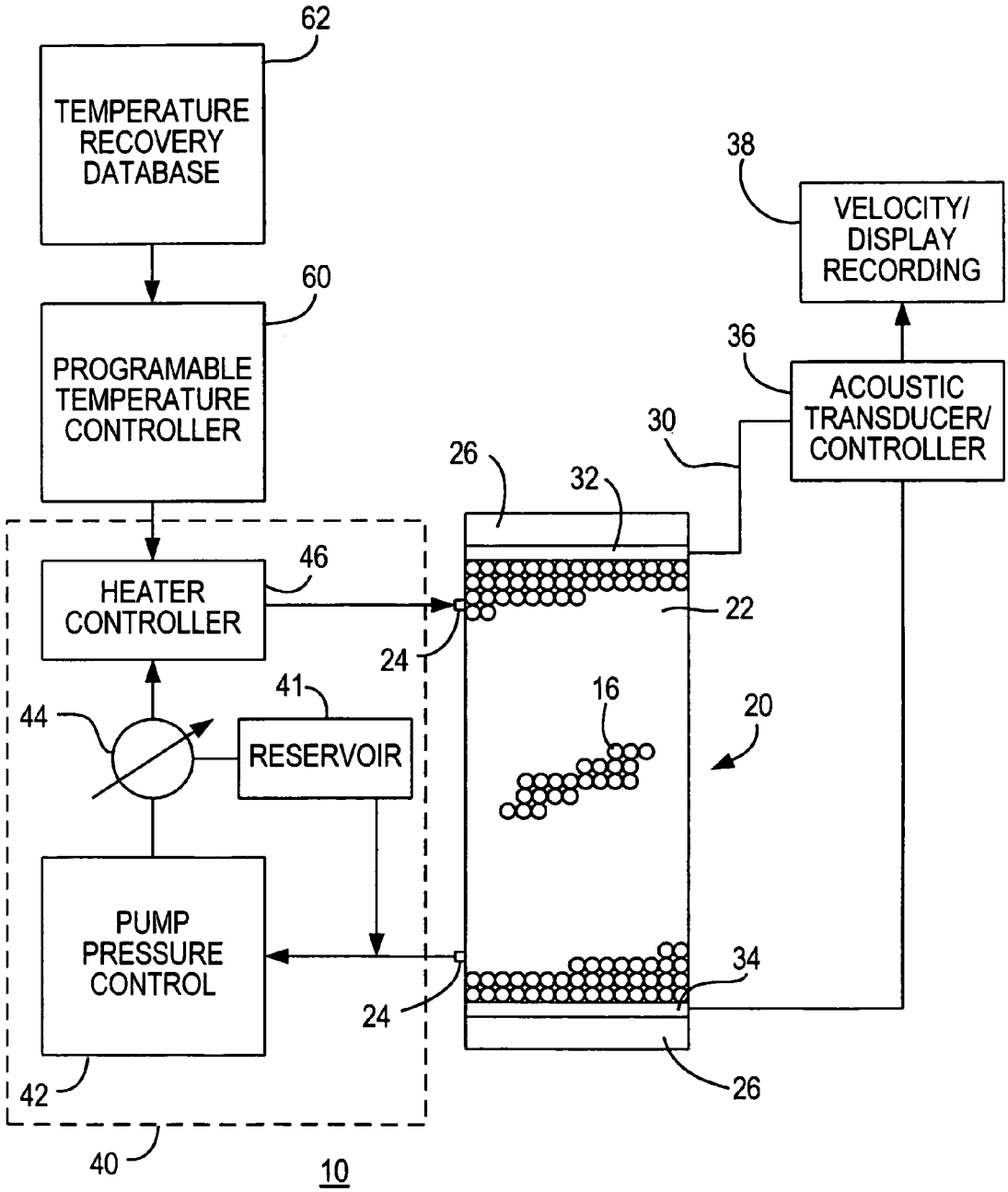
FIG. 7 is a schematic diagram of the apparatus for practicing the method of the invention.

With reference to FIG. 7, there is illustrated a test apparatus 10 assembled in accordance with the invention. Test cell 20 provides a sample receiving chamber 22, and includes a velocity transducer 30 having transmitter element 32 and receiving element 34 connected to acoustic transducer/controller 36.

Test cell 20 includes inlet and outlet ports 24 in fluid communication with a temperature-controlled and pressurized heating system 40 with a reservoir 41 that is a source of heat transfer fluid. The heating system 40 includes a pump pressure controller 42 and regulator 44 for maintaining a constant pressure on the sample in test chamber 22, and a heater 46. A heat transfer fluid, such as mineral oil of the type commonly used in laboratory test apparatus is maintained in reservoir 41, which also serves as an expansion tank as the fluid temperature increases.

Heater 46 is operatively connected to the programmable temperature controller 60 discussed above. Data from temperature recovery measurements obtained from a previously fractured well that is expected to have similar characteristics to one or more wells for which a proppant is to be selected for use is maintained in temperature recovery database storage device 62 and is loaded into the program for the temperature controller.

A sample 16 of CRCP is loaded into the chamber 22 of cell 10. The apparatus is sealed with opposing end caps 26 which are equipped with acoustic wave transmitter 32 and receiver 34, respectively. The heat transfer fluid used is MultiTherm PG-1® mineral oil sold by MultiTherm Corporation, Phoenixville Pike, Pa. at a starting temperature of 72° F. The test vessel chamber 22 containing sample 16 is pressurized to a simulated in situ closure stress (for example, 3000 psi) and the temperature is raised, e.g., in accordance with the temperature recovery profile of FIG. 1, which is also representative of the well that is to be fractured in the future and in which the test CRCP is to be used.

A triaxial loading system, model AutoLab 2000 manufactured by New England Research, known as NER, of White River Junction, Vt., was utilized in the testing. The end caps 26 of the sample mount contain ultrasonic transducer transmitter 32 and receivers 34 which can generate and detect both compressional and shear waves. One transducer is a transmitter which is excited to induce an ultrasonic wave this is preferably at a frequency of 700 KH, and the other one is a receiver. The velocities of these waves are measured every five minutes in view of the relatively flat aspect of the temperature profile curve as it approaches the formation temperature. The measurements are recorded and stored velocity display and recording device 38. More frequent measurements can be taken and recorded, as necessary depending upon the starting temperature, the rate of temperature increase and the rate of cure of the resin on the CRCP. Other frequencies, e.g., in the range of 500 MH to 1000 MH can also be used.

The temperature of the sample was increased by heating the pressurizing fluid. The pressure inside the chamber is controlled by a servo device and a pressure relief control mechanism 44 that maintains a constant hydrostatic pressure at the original predetermined value.

The acoustic wave velocity measurements from transducers 30 are transmitted from controller 36 to velocity recording and display device 38, which can also provide a graphic display of the data received on any conventional display devices. Recording device 38 can also include a program and controller that signals the system and/or the personnel when the maximum wave velocity is attained.

The temperature is increased in accordance with the time-temperature profile observed empirically in a comparable reservoir following a fracturing treatment. The temperature recovery profile is based on measurements taken and recorded in the field utilizing conventional and well-known procedures, and the resulting function is applied in the laboratory test as described above. By reproducing the temperature-time function in the laboratory test cell, the shut-in time required to obtain a stable proppant pack in the fractured reservoir rock is determined.

The recovery time (T1) for the formation temperature to reach the curing temperature can be obtained from measurements in the field or by known mathematical modeling techniques. At a given temperature, the strength of the CRCP sample increases with increasing curing time up to a point after which more time does not produce an appreciable increase in compressive strength. This laboratory-determined curing time (T2) is added to T1 to obtain the shut-in time required following a given fracturing treatment that utilizes the particular CRCP tested. It has been found that this time is generally greater than the time required to break the fracturing gel.

The laboratory results identify a transition zone of temperature during which the CRCP is curing. The optimum time is that corresponding to a maximum acoustic velocity. The temperature at which the maximum velocity is attained may be less than the reservoir temperature, which suggests that a different CRCP that cures at a lower temperature must be used. Therefore, it is important to know the temperature at which maximum acoustic velocity is obtained, compare that temperature to the reservoir temperature, and if it is less than the reservoir temperature, allow additional shut-in time for the proppant to reach that temperature.

The invention thus provides an apparatus and method to maximize CRCP strength under in-situ reservoir formation conditions, and accounts for the effect of formation cooling on the strength development of CRCP. The method can be used for the identification and selection of the appropriate CRCP and the shut-in time required to obtain a consolidated proppant pack that will not be subject to proppant flowback.

Additionally the method is used to optimize the fracturing treatment by selecting a CRCP that cures at a temperature less that the in situ reservoir temperature and preferably cures in a time period that is close to the time required to break the gel.

Although various embodiments that incorporate the teachings of the present invention have been shown and described in detail herein, those of ordinary skill in the art can readily devise other varied embodiments that incorporate these teachings and that are within the scope of the claims that follow.

We claim:

1. A method for optimizing the shut-in time during the hydraulic fracturing of a subterranean reservoir rock formation and the injection of a quanity of a specified type of curable resin-coated proppant (CRCP) particles to maintain the fractures, where the shut-in time is the period during which pressure is maintained to effect curing of the resin coating to form a proppant pack of maximum strength, the method comprising:

a. determining the temperature and pressure values of the reservoir during the fracturing process based on historical data;

b. preparing a mathematic representation of the temperature recovery of the fractured formation in the form of a temperature recovery shut-in data source;

c. preparing a test sample of CRCP sample of the type to be used in the fracturing process;

d. placing a quantity of the CRCP sample in pressurized vessel at ambident conditions;

e. placing velocity transducers in contact with opposing sides of the CRCP sample contained in the pressure vessel;

f. sealing the pressure vessel and applying an external hydrostatic force of predetermined value to the CRCP sample;

g. increasing the temperature of the CRCP sample in the vessel at a predetermined rate to thereby effect the gradual curing of the resin;

h. activating the velocity transducers at predetermined time intervals to transmit waves of a predetermined fixed frequency as the temperature of the CRCP sample increases;

i. measuring the acoustic velocity of the waves passing through the CRCP sample when the transducers are activated;

j. recording the temperature of the CRCP sample at which the maximum wave velocity is attained, said temperature corresponding to the temperature at which the resin coating on the proppant is cured;

k. correlating and recording the value of the temperature as determined in step (j) with the time required to reach said temperature from a temperature recovery shut-in data source;

l. injecting an effective quantity of the type of CRCP prepared in step (c) into the fractured formation;

m. maintaining the pressure for a shut-in time that corresponds to that determined in step (k) to establish a cured CRCP pack of optimum strength;

n. returning the formation to production.

2. The method of claim 1, wherein the temperature recovery shut-in data source is selected from a printed graphic curve, a printed or electronic chart or table, and an algorithm contained on an electronic medium.

3. The method of claim 1 in which the values of the acoustic wave velocities and the corresponding temperature and times during steps (i) and (j), respectively, are recorded electronically by an appropriately programmed general purpose computer.

4. The method of claim 1 in which steps (c) through (k) are repeated to identify the type of CRCP material having the optimum shut-in time for the conditions prevailing in the reservoir rock to be fractured.

5. The method of claim 1, wherein the externally applied hydrostatic force is maintained constant during heating.

6. The method of claim 1, wherein the applied hydrostatic force simulates the estimated force to which a proppant corresponding to the CRCP sample will be subjected during reservoir fracturing.

7. The method of claim 1, wherein the temperature in step (g) is increased in accordance with a program-controlled temperature-time function that reproduces an actual temperature recovery function derived from field measurements during the addition of fracturing fluid to a reservoir rock formation in which a proppant corresponding to the CRCP sample is to be used.

8. The method of claim 1, wherein the temperature is increased in accordance with an empirically determined rate or rates based on historical thermal recovery data obtained from the addition of fracturing fluid to a reservoir rock formation in which the CRCP is to be utilized.

9. The method of claim 1, wherein the frequency is in the range of 500 MH to 1000 MH.

10. The method of claim 9, wherein the frequency is 700 MH.

11. The method of claim 1, wherein the hydrostatic pressure applied at the beginning of the heating cycle is in the range of from 1000 psi to 10,000 psi.

12. The method of claim 1 in which the curable resin coating on the proppant is selected from the group consisting of phenolic resins, furan resins and epoxy resins.

13. The method of claim 1 in which the proppant is formed of a material selected from the group consisting of ceramic, bauxite and natural sand particles.

14. The method of claim 1 in which the CRCP sample is closely packed in the pressure vessel.

15. The method of claim 1 in which the pressure vessel is generally cylindrical in shape and the method includes sealing the transducers into the opposing open ends of the vessel.

16. The method of claim 1 in which the temperature of the CRCP sample is measured continuously.

17. The method of claim 1 which includes first activating the transducers after the temperature of the CRCP sample has reached a predetermined value.

18. The method of claim 1 which includes continuously recording and storing the temperature data and the acoustic wave data during the test.

* * * * *